United States Patent [19]

Roberts

[11] 4,174,191

[45] Nov. 13, 1979

[54] VARIABLE CAPACITY COMPRESSOR

[75] Inventor: Richard W. Roberts, Lombard, Ill.

[73] Assignee: Borg-Warner Corporation, Chicago, Ill.

[21] Appl. No.: 870,395

[22] Filed: Jan. 18, 1978

[51] Int. Cl.[2] ..... F04B 1/12

[52] U.S. Cl. ..... 417/222; 417/269

[58] Field of Search ..... 92/122; 74/60; 417/222, 417/269, 270

[56] References Cited

U.S. PATENT DOCUMENTS

| | | | |
|---|---|---|---|
| 3,951,569 | 4/1976 | Jacobs | 417/269 |
| 4,037,993 | 7/1977 | Roberts | 417/222 |
| 4,061,443 | 12/1977 | Black et al. | 417/269 |

FOREIGN PATENT DOCUMENTS

| | | | |
|---|---|---|---|
| 1271551 | 6/1968 | Fed. Rep. of Germany | 417/269 |

*Primary Examiner*—William L. Freeh

*Attorney, Agent, or Firm*—Thomas B. Hunter

[57] ABSTRACT

A controllable, variable displacement swash plate compressor including a centrally pivoted swash plate on a rotating shaft. Control means are provided to increase or decrease the angle of inclination of the swash plate in response to changes in suction pressure. The delivery from the compressor may be reduced rapidly from the maximum as the angle of inclination is reduced, due parly to the reduction in stroke, but mainly to the increased clearance volume, i.e. the volume above the piston in the cylinder, and the consequent re-expansion of the trapped gas in the clearance volume. This achieves a more efficient method of reducing compressor output to match system requirements than suction gas throttling, a commonly used technique in automotive air conditioning applications. In addition, it does not require a clutch since it may be run for prolonged periods at or near zero capacity (no-stroke condition) when cooling is not required.

3 Claims, 4 Drawing Figures

10
12
13
14
16
18
20
22
23
24
25
26
28
30
32
33
34
36
42
44
45
46
47
49
51
52
54
56
58
60
61
62
63
64
66
68
70
72
73
74
76
78
80
82
84
86
88
89
90
92
93
94
96
98
99
100
101
102
103
104
105
112
114
A
B
C
D
E
2
3

VARIABLE CAPACITY COMPRESSOR

BACKGROUND OF THE INVENTION

1. Field of the Invention

Variable capacity swash plates compressors normally classified in Class 417, Subclass 53.

2. Description of the Prior Art

U.S. Pat. No. 3,861,829, assigned to the same assignee as the present invention, (Roberts et al, issued Jan. 21, 1975) discloses a swash type compressor in which the clearance volume at zero stroke is very small because of the unique manner of pivoting the swash plate at a point displaced from the drive shaft axis. Control of the compressor is achieved by varying the pressure inside the crankcase (this pressure being applied underneath the pistons) to establish an equilibrium position of the swash plate to satisfy capacity requirements.

U.S. Pat. No. 3,062,020 (Heidorn) discloses a wobble plate compressor using a hydraulic mechanism to vary the stroke. The pivot point, however, is moveable along the axis of the drive shaft so that it is essentially a fixed clearance volume compressor.

SUMMARY OF THE INVENTION

This invention relates generally to swash plate compressors in which the swash plate is moveable with respect to the drive axis to vary the inclination thereof and accordingly vary the effective stroke of the pistons driven by said swash plate. In the present invention, the construction of the compressor is greatly simplified and much less expensive than the aforementioned Roberts et al compressor described in U.S. Pat. No. 3,861,829 and is more efficient than the conventional fixed displacement swash plate air conditioning compressors which utilize a suction throttling valve.

DETAILED DESCRIPTION OF THE INVENTION

Figure 1:
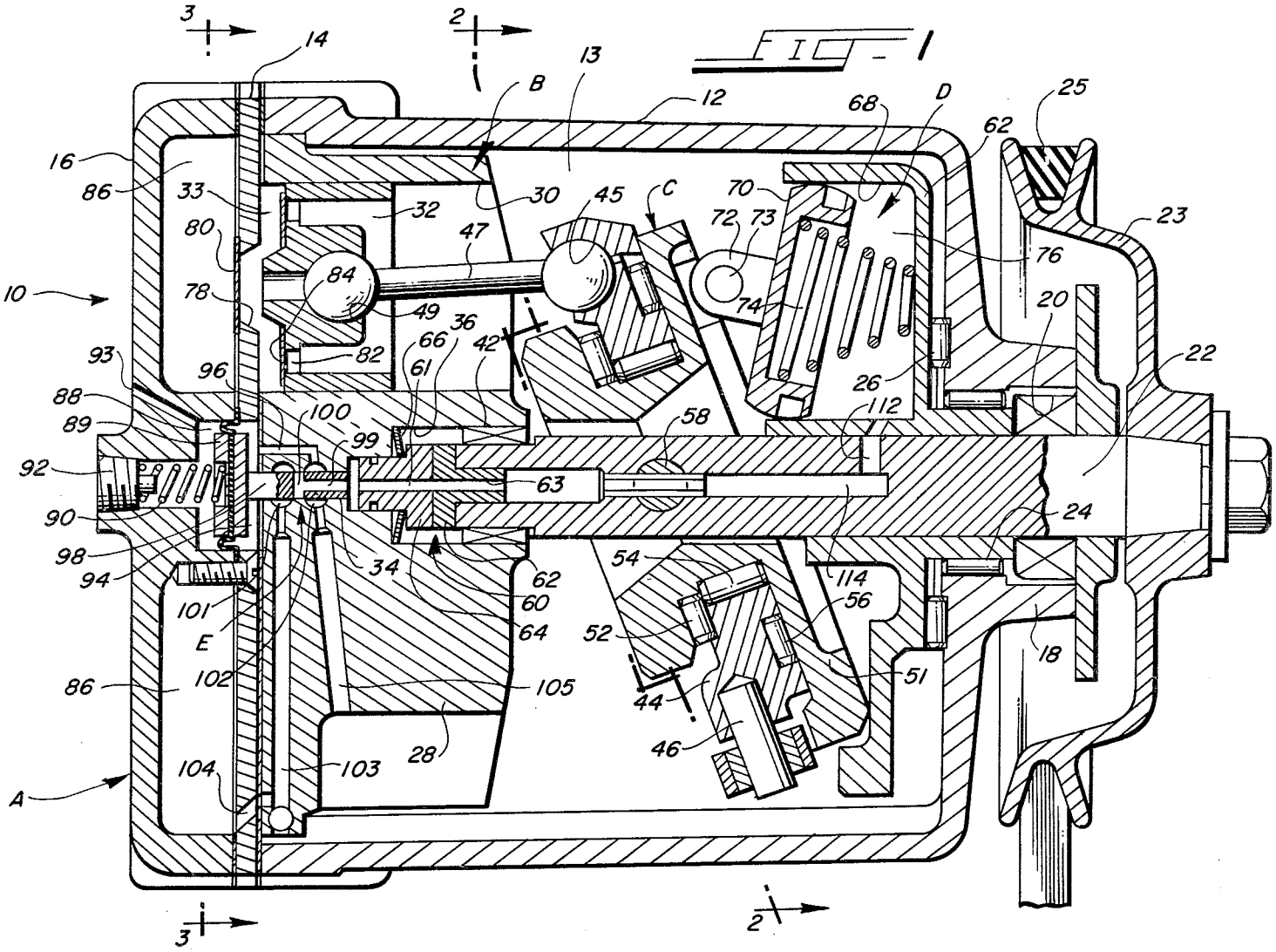
FIG. 1 is a cross-section view of a swash plate compressor constructed in accordance with the principles of the present invention.
Figure 2:
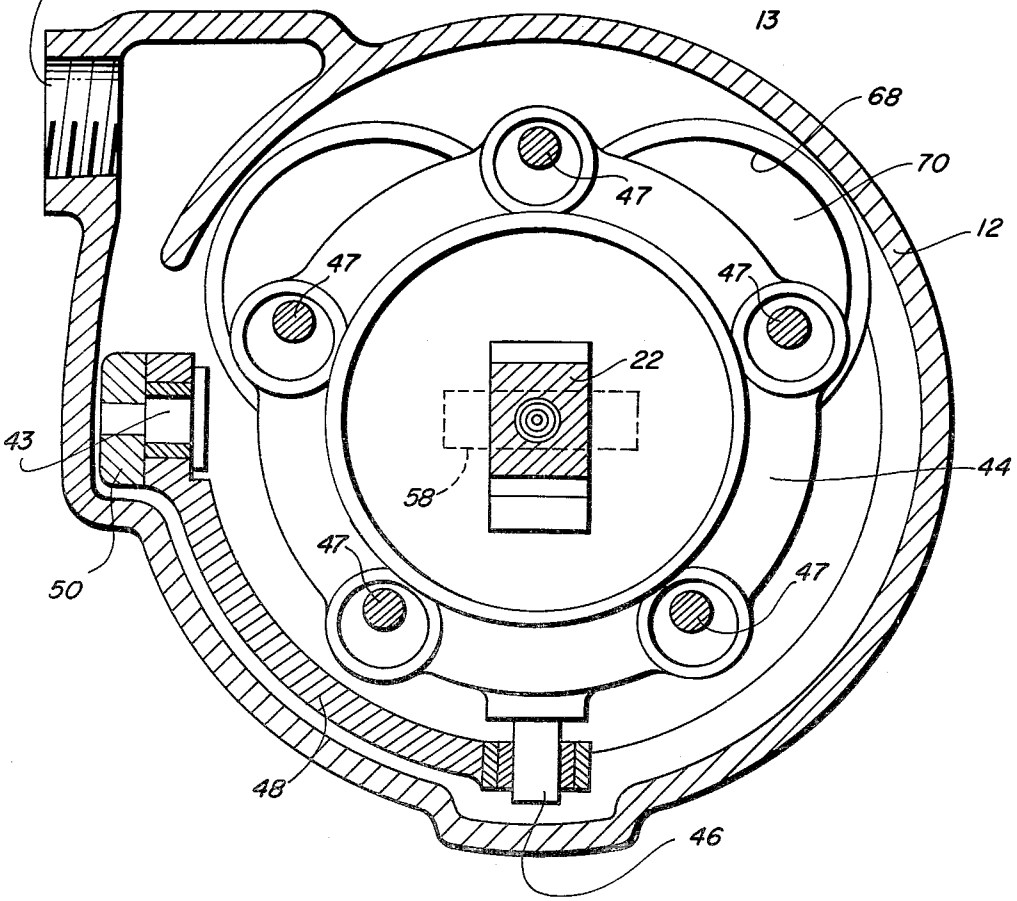
FIG. 2 is a cross-section view taken along the plane of line 2—2 of FIG. 1.
Figure 3:
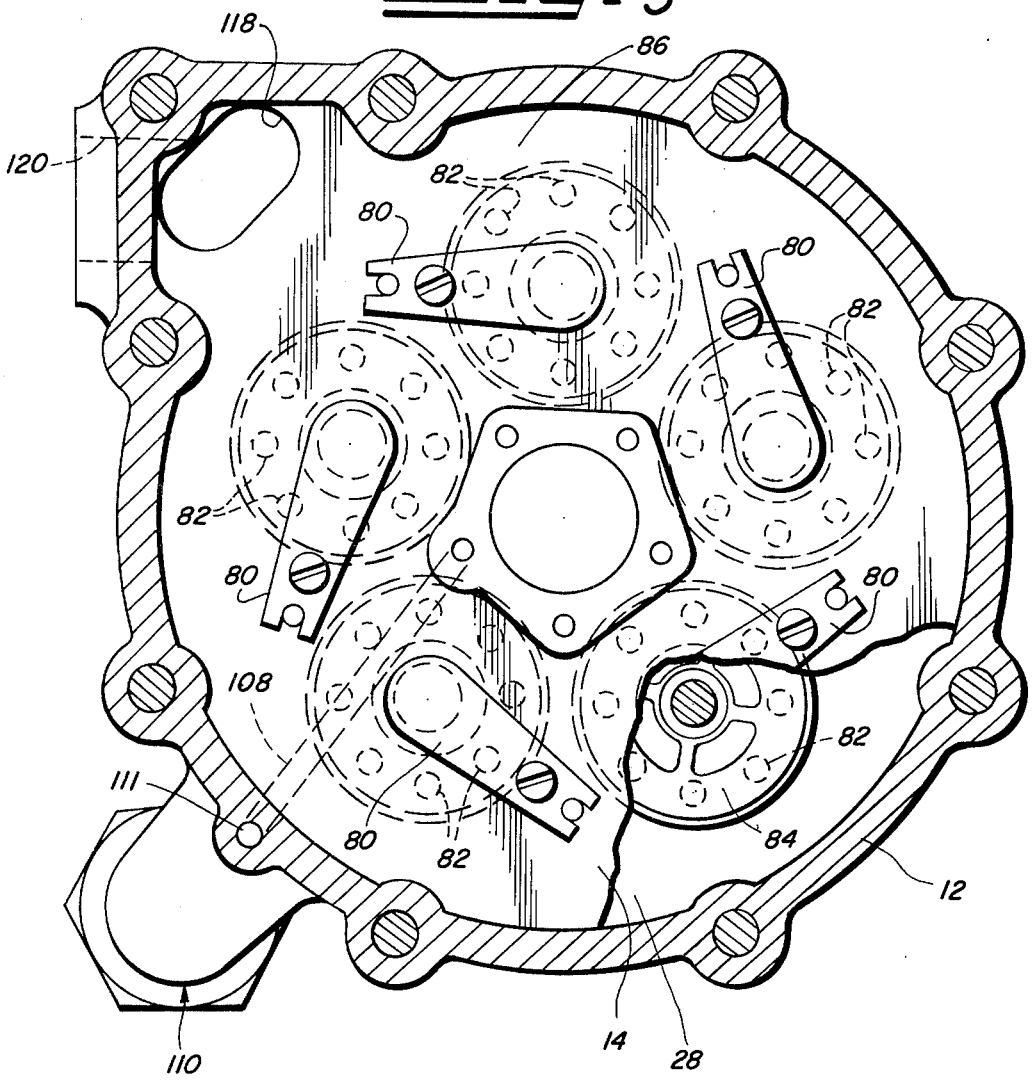
FIG. 3 is a cross-section view taken along the plane of line 3—3 of FIG. 1.

The compressor, as best shown in FIGS. 1-3 inclusive, is organized into several major components: the head and valve plate assembly A, the cylinder block assembly B, the drive and swash plate assembly C, the actuator assembly D and the fluid control valve assembly E. The compressor, generally designated as 10, includes a bell shaped housing 12 having an open end (at the left side of FIG. 1) which is closed by a valve plate 14 and head 16.

The opposite end of housing 12 (to the right side of FIG. 1) has an axially extending boss 18 and an opening 20 therethrough to accommodate the drive shaft 22 which is supported in a bearing assembly including a radial bearing 24. The drive shaft is adapted to be driven by a pulley 23 which is affixed to the right-hand end. Although a direct drive may be used, it is conventional, particularly in automotive air conditioning applications, to drive the compressor from an accessory drive pulley through a V-belt 25. The drive shaft is secured, by a key or similar device, to a reaction plate 62 which engages a thrust bearing 26. Piloted in a recess at the left end of the housing is the cylinder block 28 which includes a plurality of cylinder bores 30 each receiving a piston 32 reciprocably moveable within the cylinder. The top portion of the piston, the cylinder bore and the lower surface of the valve plate 14 form a gas working space 33 for the compression of gas or vapor introduced therein. The central portion of the cylinder block is provided with: a bore 34 extending therethrough to receive the control valve assembly E which will be described in more detail below; and a counterbore 36 to accommodate a seal 60 and a radial bearing 42 in which the left end of the drive shaft 22 is supported.

The drive and swash plate assembly C includes a swash plate 44 which is constrained from rotation by means of a pin 46 carried by an arcuate shaped arm 48 (FIG. 2) pivoted at its opposite end along an axis perpendicular to the axis of the pin 46 by means of an arm-like axial extension 50 of cylinder block 28. This permits the swash plate to pivot around the axis of pin 46 and also around the perpendicular axis of the other pin 43 holding the arcuate arm to the housing extension.

The face of swash plate 44 is provided with a plurality of sockets 45 which capture a ball-shaped end of connecting rod 47. In a similar manner, each of the pistons 32 has a socket 49 capturing the opposite end of the connecting rods. The swash plate 44 is carried on a cam mechanism or drive plate 51 by means of three bearings: a front thrust bearing 52, a radial bearing 54 and a rear thrust bearing 56. The drive plate is supported on a cross pin 58 which extends through the drive shaft 22 so that it may be pivoted from the position shown in FIG. 1, in which the swash plate is driven in a nutating path, and imparting reciprocative motion to pistons 32, to a position generally perpendicular to the drive shaft axis. When it is in the latter position, the swash plate will be virtually stationary and therefore no pumping will take place within the gas working spaces.

A rotary seal assembly 60 is provided at the left hand portion of the drive shaft. Plug 62 is inserted in and rotates with the drive shaft 22; and a stationary plug 64 is fitted in a counterbore in cylinder block 28 immediately adjacent thereto. Passage 61 in plug 62 and passage 63 in plug 64 are aligned to permit the flow of fluid therethrough. A Belleville spring 66 biases the stationary portion of the seal against the rotating portion to prevent fluid losses.

The control of the swash plate position is achieved by means of actuator assembly D. The reaction plate 62 rotates with drive shaft 22 and is journalled in radial bearing 24 and thrust bearing 26. The reaction plate is provided with a pair of spaced cylinders 68 which receive pistons 70. Each of the pistons is connected to the drive plate 51 through lugs 72 and pins 73. Conical springs 74 urge the pistons outwardly tending to move the swash plate to the full stroke position.

The reaction force of the pumping pistons compressing gas in working spaces 33 will tend to move the swash plate to a vertical (zero-stroke) position. However, when the control volume 76 inside each cylinder 68 is pressurized, the actuator pistons, assisted by springs 74, will move outwardly causing an increase in the angle of the swash plate and increased pumping capacity.

Turning now to the head and valve plate assembly A, the valve plate 14 is provided with a series of discharge ports 78, one for each cylinder in the center of the piston area. Each of these ports is covered by a flapper type discharge valve 80. Similarly, each piston is provided with a series of circumferentially spaced suction gas ports 82 which are covered by a suction valve 84 on the crown of the piston. This permits the gas to flow from a space underneath the piston, that is in the crankcase area, through ports 82, past the suction valve 84 and into the gas working space 33 when the pistons are moving away from the valve plate. Upon reversal of the stroke, the suction valve will close, trapping the gas and allowing compression thereof to a point where the discharge valve 80 will open and cause flow into the discharge gas plenum 86 enclosed by the head member.

OPERATION

Figure 4:
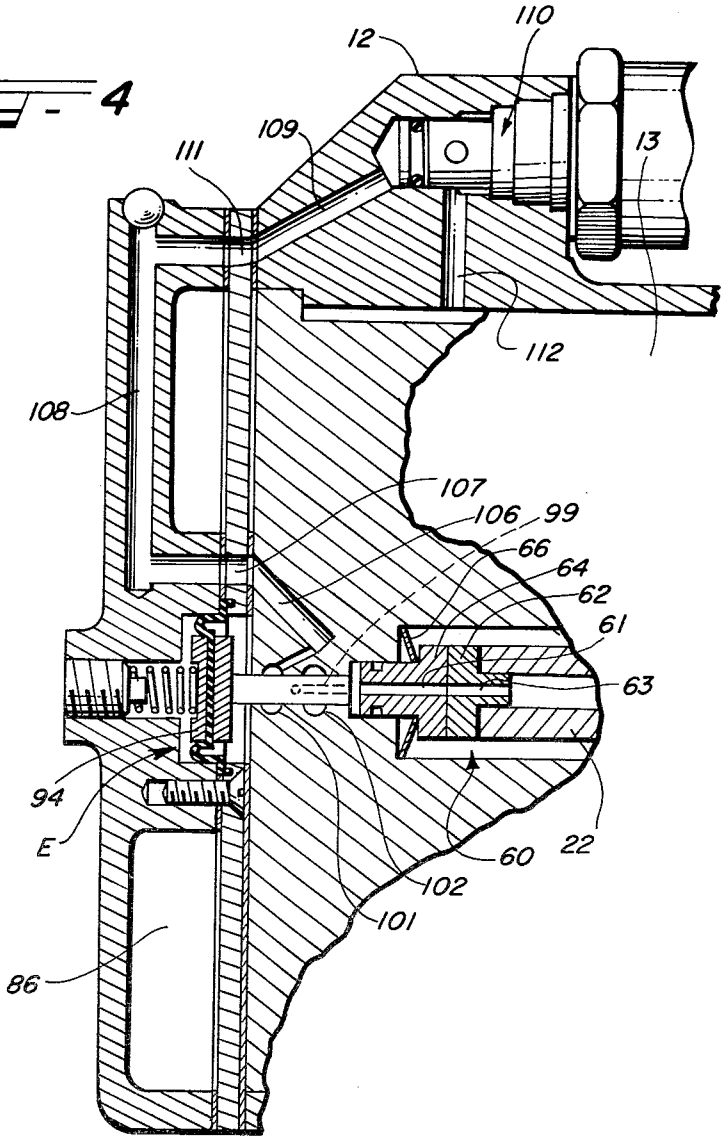
FIG. 4 is a partial cross-section view across a portion of the head and valve plate assembly showing certain fluid control passages.

As best shown in FIGS. 1 and 4, the central portion of the head member 16 is provided with a chamber 88 receiving a bellows type diaphragm valve actuator 89. The left hand side of the valve actuator is engaged by means of a spring 90 under compression, the preload being adjustable by means of set screw 92. Atmospheric pressure is applied to the left hand side of the actuator through passage 93 while suction pressure is applied to the chamber 94 inside the diaphragm through a passage 96.

A valve spool 98, slidable axially in bore 34 and attached to actuator 89, has a longitudinal passage 99 and an intersecting transverse passage 100. The bore is provided with two spaced grooves 101, 102. Groove 101 is connected through passage 103 in the cylinder block and passage 104 in the valve plate 40 with discharge pressure in discharge gas plenum 86. The other groove 102 is connected to suction pressure by means of passage 105 in the cylinder block.

As best shown in FIG. 4, the left hand groove 101 also connects with a solenoid valve 110 which controls the on/off operation of the compressor as follows: groove 101 connects with passage 106 in the cylinder block, a port 107 in the valve plate assembly, a passage 108 in the head, port 111 in the valve plate and passage 109 in the casing 12 which leads the inlet side of solenoid valve 110. Another passage 112 connects between the solenoid valve and the crankcase. When the solenoid valve is open, that is moved to the right, the pressure in the left hand groove 101 is vented into the crankcase; so that it is no longer available to hold the swash plate in the operating position. When the solenoid valve is closed, this path is blocked as shown in FIG. 4, which results in discharge pressure being available at groove 101 when in the operating mode.

In the operating mode, the control functions as follows. Assume that the suction pressure increases thus indicating a need to increase the capacity of the compressor. In this case, the suction pressure applied to the closed space 94 under the diaphragm would cause the bellows unit to expand and move to the left as viewed in FIGS. 1 and 4. This would move the spool to the left causing communication between groove 101 and the transverse passage 100 and axial passage 99 through the spool. In this case discharge pressure would be applied from the discharge gas plenum 86, passage 104 in the valve plate, passage 103 in the cylinder block through the spool passages 100, 99, passages 61 and 63 in the seal, the longitudinal passage 114 extending through the drive shaft and through a passage 112 into the space 76 underneath the pistons 70. This would cause the pistons to move to the left increasing stroke and capacity.

If suction pressure should drop to the point where a decrease in capacity is desired, the diaphragm element will collapse causing corresponding movement of the spool to the right due to the action of spring 90. Then transverse passage 100 connects with groove 102. This would permit the pressure underneath the pistons in the actuator assembly to be relieved through passage 105, thus producing a more vertical orientation of the wobble plate and reducing stroke and capacity.

The section gas connection for the compressor is shown at 116 in FIG. 2. Gas admitted at this point completely fills the crankcase 13 enveloped by housing 12 thus being available at the suction ports 82 and control passage 105. The discharge gas flows from discharge plenum 86 (see FIG. 3) through an opening 118 in the valve plate and a connecting passage in the housing to a discharge gas connection at 120.

While this invention has been described in connection with a certain specific embodiment thereof, it is to be understood that this is by way of illustration and not by way of limitation; and the scope of the appended claims should be construed as broadly as the prior art will permit.

What is claimed is:

1. A compressor comprising: means defining a plurality of gas working spaces each having a piston cooperating with suction and discharge ports to compress a fluid therein; a drive shaft; a cam mechanism driven by said drive shaft; a swash plate driven by said cam mechanism in a nutating path about the drive shaft axis; means operably connected between said swash plate and the individual pistons to impart reciprocating drive to said pistons; means for pivoting said swash plate and said cam mechanism at a fixed point along the drive shaft axis such that the stroke length of the pistons may be varied; means for constraining rotational movement of said swash plate, said means including an arcuately shaped arm pivoted at one end in a fixed support, a pin extending from the opposite end of said arm and engaging said swash plate, the axis of said pin and the pivot axis of said one end of said arm being perpendicular; a fluid operated actuator operatively connected to said swash plate to vary the position thereof, said actuator having a fluid chamber cooperating with a moveable piston, and means for controlling the pressure in said chamber in response to suction pressure.

2. A compressor as defined in claim 1 including a pressure control valve having a first position wherein fluid at discharge pressure is directed into said fluid chamber to increase the pressure therein and move said swash plate toward a position to increase stroke length, said valve having a second position wherein fluid in said fluid chamber is vented to suction pressure to reduce the pressure therein and move said swash plate to decrease stroke length.

3. A compressor as defined in claim 1 including resilient means for urging said moveable piston in a direction which tends to increase the stroke length of said reciprocatively driven pistons.

* * * * *